US005596858A

United States Patent [19]

Jordan

[11] Patent Number: 5,596,858

[45] Date of Patent: Jan. 28, 1997

[54] COVER FOR STANDING SEAM OF ROOF WHICH IS CLAD WITH PLASTIC MEMBRANE

[75] Inventor: Franklin F. Jordan, Oakville, Canada

[73] Assignee: Prospex Roofing Products Inc., Mississauga, Canada

[21] Appl. No.: 563,429

[22] Filed: Nov. 24, 1995

[51] Int. Cl.[6] ..... E04D 3/36

[52] U.S. Cl. ..... 52/460; 52/466; 52/469; 52/519; 52/542; 52/716.8; 52/718.02; 52/717.03; 52/717.04; 52/717.05

[58] Field of Search ..... 52/537, 521, 467, 52/465, 462, 410, 408, 460, 716.8, 718.02, 717.03, 717.04, 717.05, 466, 469, 519, 542

[56] References Cited

U.S. PATENT DOCUMENTS 1,447,175 3/1923 Henderson ..... 52/467

4,790,112 12/1988 Wang ..... 52/465 X 4,893,449 1/1990 Kemper ..... 52/467 X

*Primary Examiner*—Christopher T. Kent

*Attorney, Agent, or Firm*—Jane Parsons

[57] ABSTRACT

A sheet roofing system involving the use of a plastics material membrane may be applied over existing metal roofs. A plastics material extrusion which may be colour matched or contrasted with the colour of the plastics material membrane may be applied over standing seams or other ridges. The extrusion is a U shaped cover, of which one leg is hinged for easy installation of the cover over the standing seam. The hinge is designed to avoid undue stresses on the plastics material of the cover. In one embodiment, the hinge is a hollow tubular region along the length of the extrusion between the leg of the U and the web of the U which forms the top of the cover.

7 Claims, 5 Drawing Sheets

COVER FOR STANDING SEAM OF ROOF WHICH IS CLAD WITH PLASTIC MEMBRANE

BACKGROUND OF THE INVENTION

1. Field of the Invention

This invention relates to sheet roofing systems.

2. Description of Prior Art

Traditionally many roofs, especially roofs of large buildings such as arenas, barns, industrial warehouses and the like, have been made from sheet metal material. Sheet metals tend to be expensive and are difficult to handle, especially in high winds. Joins between the sheets have needed special waterproofing techniques. When the metal sheets are intended to be especially decorative rather than merely utilitarian, the expense is even greater. Frequently such decorative metal sheets may be formed of copper.

While metal roofing systems have not been superseded it has become relatively common to use, in their place or to cover them, roofing systems in which the covering material is a flexible plastics material. Frequently the plastics material is ethylene propylene diene monomer (EPDM rubber). Alternatively it may be polyvinyl chloride (PVC). Either of these materials may be coloured either to mimic the colourings of natural metal roofing systems or in other colours that can only be achieved on metal by paint or other coating.

In one respect, metal sheeting may have some small advantage over the conventional use of plastic sheet in that metal sheeting may be provided with molded decorative ribs and grooves or other decorations. This type of decoration cannot conveniently be molded into flexible plastic sheeting in the same way as is possible for semi-rigid or rigid metal sheet. Metal sheeting is usually joined one sheet to another at an upstanding crimped seam, which may be made as a decorative feature.

If the metal sheet is to be covered with plastic sheet it may be convenient to join adjacent plastic sheets at the crimped join so that the join in the plastic sheet may be incorporated in the decorative appearance of the join. Alternatively, the plastics sheet may cover the crimped seam.

The geometry of a crimped seam can vary generally from 1 inch to 3¼ inches high although other heights are possible. Usually the seam has a bulge to one side due to the bent over crimp.

Sometimes plastics material sheet such as PVC sheet is applied over an existing metal roof which is often a sloping roof. Whether or not, the body of the plastics sheet or overlapping edges of adjacent plastics sheets coincide with a standing seam, difficulties arise in providing a neat fit of the plastics sheet with the roof contour at this point in water. When overlapping edges occur, waterproofing may be a problem.

U.S. Pat. No. 4,833,853 to Deibele et al discloses mechanical fixing system at the edges of plastic sheet in which an elongated mounting bracket provides a grip for a cover member. The plastic sheet is attached to the mounting bracket by screws and the cover member provides waterproofing. The mounting bracket is of complex form and the edges of overlapping sheets are drawn up to cover the head of the screw. There is, however, no provision for the presence of a standing seam.

Exemplary of patents concerning semi-rigid or rigid roofing sheets is U.S. Pat. No. 4,366,656 issued Jan. 4, 1983 to Simpson. U.S. Pat. No. 4,269,012 issued May 26, 1981 to Mattingly et al discloses a roofing system in which the edge of one metal sheet is bent to form a cover for the edge of an adjacent sheet. In the disclosure of this patent, a cap is shown over the standing seam to prevent water ingress. No covering plastics sheet is used.

The present inventor has addressed the problem of laying a cover plastics sheet material over a standing seam of a metal roof or indeed over any upstanding ridge. Since many colours are available in plastics sheet, it is desirable that any waterproofing or fixing of the sheet in the region of the standing seams or other ridges should match or provide other decorative finish with respect to the sheet colour. The present inventor has also addressed the problem of providing simplicity of installation with a minimum number of parts; and the need to keep the installation inexpensive by minimizing labour costs.

SUMMARY OF THE INVENTION

According to the invention there is provided a cover for a standing seam of a roof or other structure comprising a U section extrusion of plastics material in which one leg of the U is hinged to a top web of the U.

Also according to the invention there is provided a cover for a standing roof seam comprising an elongate extrusion of plastics material having a first side web to form a first downwardly extending side leg of the cover; a top web and a second side web to form respectively, a top of the cover and a second downwardly extending side leg parallel to the first downwardly extending side leg; an elongate bending region being provided between the first side web and the top web along the length of the extrusion whereby the first side web is bendable with respect to the mid and second side webs into and out of position as the first downwardly extending leg; the cover including an elongate recess to accommodate a laterally projecting part of the standing seam.

The first web may have an inner surface to lie flat against one vertical surface of the seam and the second web may have an inner surface to lie flat against the other vertical surface of the seam. A recess may be provided adjacent the inner surface of either web to accommodate any bulging part of the seam which extends outwardly of its vertical surfaces. For example, many standing seams are formed by bending over raw edges of metal and crimping the bent over portion. This forms a projection to one side of the seam which may be accommodated in a recess of one web or the other of the extrusion. Sometimes the standing seam is profiled, for either decorative or structural reasons, to project to each side. In this case both sides of the extrusion of the extrusion may be provided with recesses to accommodate the projections.

Generally, however, any projection of the standing seam will be to one side only. Thus, it is possible to provide extrusions of similar dimensions that may fit over most general standing seams. It is only necessary that the recess in one web should be deep enough to accommodate the most general range projection of bulges from standing seams and wide enough to accommodate the general range of height of such bulges.

Conveniently, fastening means, such as screws or bolts, may be provided to pass through the seam from one web to the other in the region of their surfaces which lie flat against the vertical surfaces of the seam. Such screws or bolts should be self-tapping for easy penetration of the seam itself.

If only one side web, for example, the second side web is profiled to accommodate a bulge of the seam the other side web, for example, the first side web may be quite thin. Thus a screw on bolt may pass from an outer surface of the first side web through the first side web and through the seam to lodge in the second side web. Tightening the screw will tighten the side webs (or downwardly extending legs) about the seam.

The inner surfaces of the side webs which abut the seam may be roughened or ribbed to make good frictional contact with the seam with less tendency to slip thereon.

The elongate region of bending is intended to facilitate installation and may be provided in any convenient manner. It is, however, especially convenient to provide an elongate hollow tubular region within the extrusion extending from end to end. The dimensions of this tubular region are such as to maintain sufficient durability and strength of the plastics material of which the extrusion is made while providing a compressible region which allows and directs distortion by manual bending. The tube may be open at each end so that there is little resistance to compression.

When an attempt is made to bend the extrusion longitudinally, air in the tubular region will tend to displace and/or compress to encourage bending along the central axis of the tube. The tubular region may be of any convenient shape and is provided by a blank in the extrusion die for forming the extrusion. While the invention has so far been described as if the extrusion were located directly over the standing seam, it is to be understood that one important use of the invention is to fix and match any plastics material, e.g., PVC, membrane which is laid over an existing metal roof. Extrusions according to the invention may be colour matched or contrasted with the colour of the membrane which overlies the standing seam.

Similarly, the invention has been described with respect to standing seams but other upstanding ridges occur on roofs for decorative or structural reasons. In this specification and claims, "standing seam" is to be understood to include ridges having two parallel vertical surfaces flush with one another.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
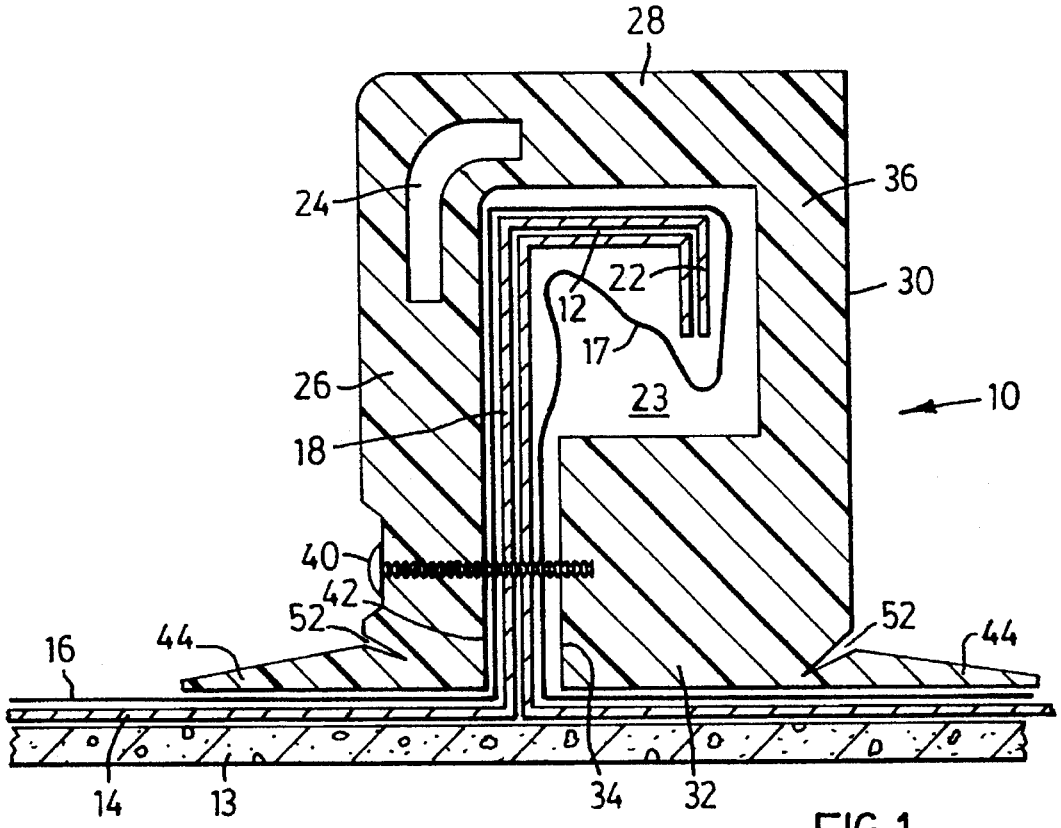
FIG. 1 shows an extrusion according to the invention bent into position and fixed to a crimped metal standing seam of a roof.
Figure 3:
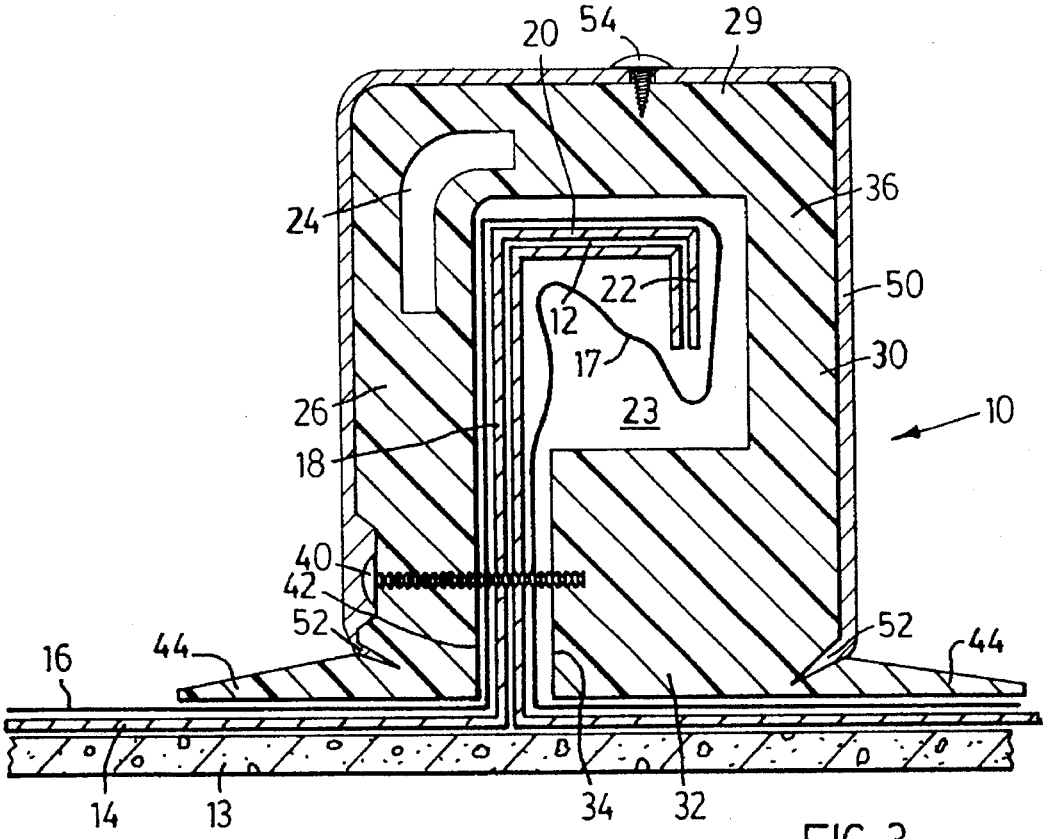
FIG. 3 is a view similar to FIG. 1 but including a flashing cap for the extrusion.

FIG. 1 shows an extrusion 10 according to the invention in a bent over position so that it covers crimped metal standing seam 12 of a roof 14. The crimped metal standing seam 12 is first covered with a PVC membrane 16 which is shown as continuously covering the standing seam 12 but which, it will be appreciated, could include a membrane to membrane join in the region enclosed by the extrusion 10 as shown in FIG. 3.

The standing seam 12 is of common profile comprising an upstanding leg 18 and a bent over top portion having a horizontal part 20 and a downwardly depending leg 22. It may be seen therefore, that the crimped metal seam extends appreciably sideways towards the right of the drawing.

Figure 2:
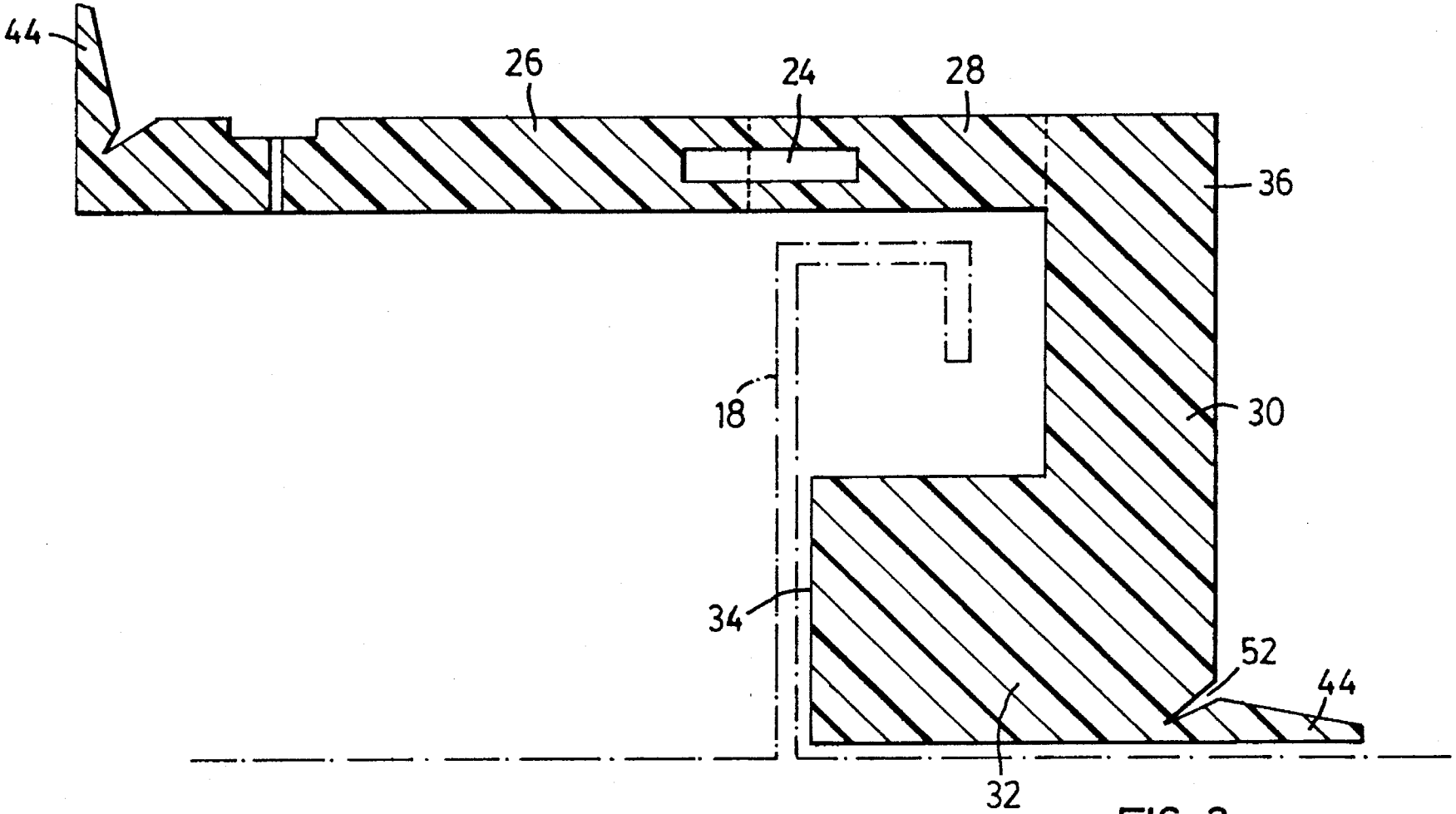
FIG. 2 is a section of the extrusion of FIG. 1 before it is bent about the crimped metal standing seam.

Extrusion 10 is extruded having a section in the shape shown in FIG. 2 and is bent about an elongate region of bending 24 into the shape shown in FIG. 1 when it is installed over standing seam 12. The extrusion 10 is a U shaped cover of which one of the legs is hinged. It comprises a first side web portion 26, a mid web portion 28 and a second side web portion 30. As shown in FIG. 1, the side web portion 26 has been hinged downwardly along the region of bending 24 from the shape of FIG. 2 into the U shape of FIG. 1 to form a downwardly extending leg. Web portion 28 forms the top of the cover 10 and side web 30 extends downwardly to form a second downwardly extending leg. Side web 30 is of considerably more substance than side web 26 and is generally of L shape having a lower thickened foot portion 32 which has an end wall 34 butting a vertical surface of the upstanding portion 18 of standing seam 12. The top portion 20 and downwardly depending portion 22 of standing seam 12 are located in the angle of the L between foot portion 32 and vertical portion 36. Top web 28 extends over the standing seam 12 so that the projecting portion 20 and the downwardly depending portion 22 of standing seam 12 are actually located in recess 23 formed by a combination of top portion 28 and L shaped side web 30. Also located in this recess 23 is bunched surplus plastics membrane 17.

The dimensions of this recess 23 formed between top web 28 and L shaped side web 30 may be chosen to accommodate any usual shape and size of standing seam 12. Side web 26 is fastened through standing seam 12 to foot portion 32 of side web 30 by means of a self tapping screw or bolt passing from an outer surface 38 of side web 26 through side web 26 and through standing seam 12 to lodge in foot portion 32 of side web 30. As the screw 40 is tightened, the side webs 26 and 30 are drawn together so that surface 34 of foot portion 32 and surface of 40 of side web 26 tighten about upstanding portion 18 of standing seam 12. Surfaces 40 of side web 26 and 34 of foot portion 32 may be roughened or ribbed to provide some frictional grip with upstanding portion 18 of standing seam 12. Each of side webs 26 and 30 are provided with an outwardly extending flange 44 to lie against a roof surface 46 extending to each side of standing seam 12.

Extrusion 10 may be produced in pre-bent U shape shown as installed in FIG. 1. However, it may be more convenient to extrude extrusion 10 in the form shown in FIG. 2 in which side web 26 has not yet been hinged downwardly to form downwardly extending leg on one side of upstanding portion 18 of standing seam 12. In either case, the extrusion is installed in the following manner.

Standing seam 12 is located with its bulging portion comprising top 20 and depending portion 22 in the recess 23 formed by L shaped web 30 and top portion 28 of the extrusion. If the extrusion has been extruded in pre-bent form it will be necessary to lift side web 26 to hinge away from foot portion 32 of side web 30 to allow access of standing seam 12 between them. If, on the other hand, the extrusion has been extruded in unbent form as shown in FIG. 2, it is easily lodged in place with surface 34 foot portion 32 of side web 30 against one side of upstanding portion 18 of standing seam 12. The bulging portion of standing seam 12 fits into the recess between top portion 28 and vertical part 36 of side web 30. The installer then hinges side web 26 downwardly to form a downwardly extending leg and abut the other side of upstanding portion 18 of standing seam 12.

Hinging of side web 26 with respect to top web 28 and side web 30 is facilitated by the provision of the bending region 24 of the extrusion. The bending region 24 comprises a hollow tubular part of generally rectangular cross section within extrusion 10 having, as its central axis, a desired line of bending. The hollow tubular portion 24 may be of any convenient shape. As shown it is of generally rectangular section but it may be of circular or oval or, indeed nearly any other section. The purpose of this hollow elongate tubular portion 24 is to minimize the distortion of the material from which the extrusion 10 is formed on hinging of side web 26 either towards or away from side web 30. Hollow tubular portion 24 may be provided in the extrusion by the provision of a blank in the extrusion die.

When cladding a metal roof with a plastic membrane 16, the plastic membrane 16 is first laid over the roof to extend over the standing seam 12. Initially, whether the membrane is laid with a loose fold of membrane over the standing seam 12 or whether it is laid with edges of two adjacent membranes in the region of standing seam 12, it may be difficult to tightly match the membrane into the angles of the standing seam.

When utilizing an extrusion according to the present invention the membrane 16 may be laid quite loosely initially. Tightening of the screw 40 to draw surfaces 42 and 34 of web members 26 and 22 together will tend to tighten the membrane on the roof surface. Bunching 17 of the membrane 16 will be accommodated in the recess housing the projecting part of standing seam 12. The heads of screws or bolts 40 may be unobtrusively housed in a groove on the outer surface of side web 26 intended for this purpose. Moreover, side web 26 may be provided with a pre-drilled hole to provide easy insertion of the screw 40 or bolt. Still further, the location of the screw 40 or bolt may be above the level of the general roof surface 13 so that any water penetration along the axis of screw 40, if it happens at all, is unlikely to reach the roof surface.

The extrusion 10 may be formed of any readily extrudable plastics material which will stand up to weathering. For example, it may be a polyethylene based polymer such as polyvinyl chloride, and it may possibly be reinforced with glass fibre. The extrusion may be manufactured in a colour to match the membrane, or if desired, it may be manufactured in a contrasting colour. Alternatively, a flashing cap 50 may be provided for the extrusion as shown in FIG. 3. FIG. 3 shows a similar extrusion to that of FIG. 1 with the exception that a flashing cap 50 is provided and the plastics material membrane is shown with a break in the bunching 17 within the extrusion indicating adjacent membrane 16.

Flashing cap 50 may be located in notches 52 at the foot of each web member 26 and 30. Slots 52 may serve a dual purpose in that they allow minor adjustment of the plane of foot flanges 44 to easily follow the plane of the roof. The edges of flashing 52 may be inserted in these slots which further fixes the flanges 44 firmly against the roof. The flashing may be further secured by small self tapping screws 54 which pass through the flashing to fasten it against the top surface of top web 28 of the extrusion 10.

Figure 4A:
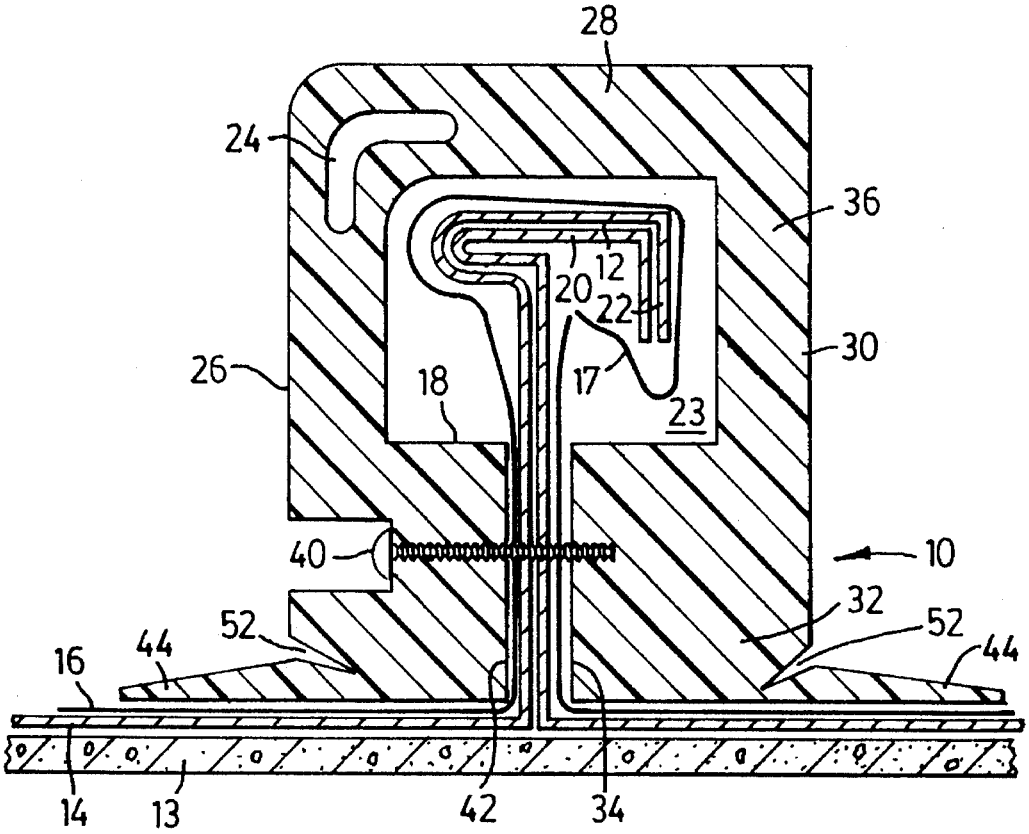
FIG. 4A and 4B, 5A and 5B show different embodiments of extrusions according to the invention in bent installed and uninstalled form.
Figure 5A:
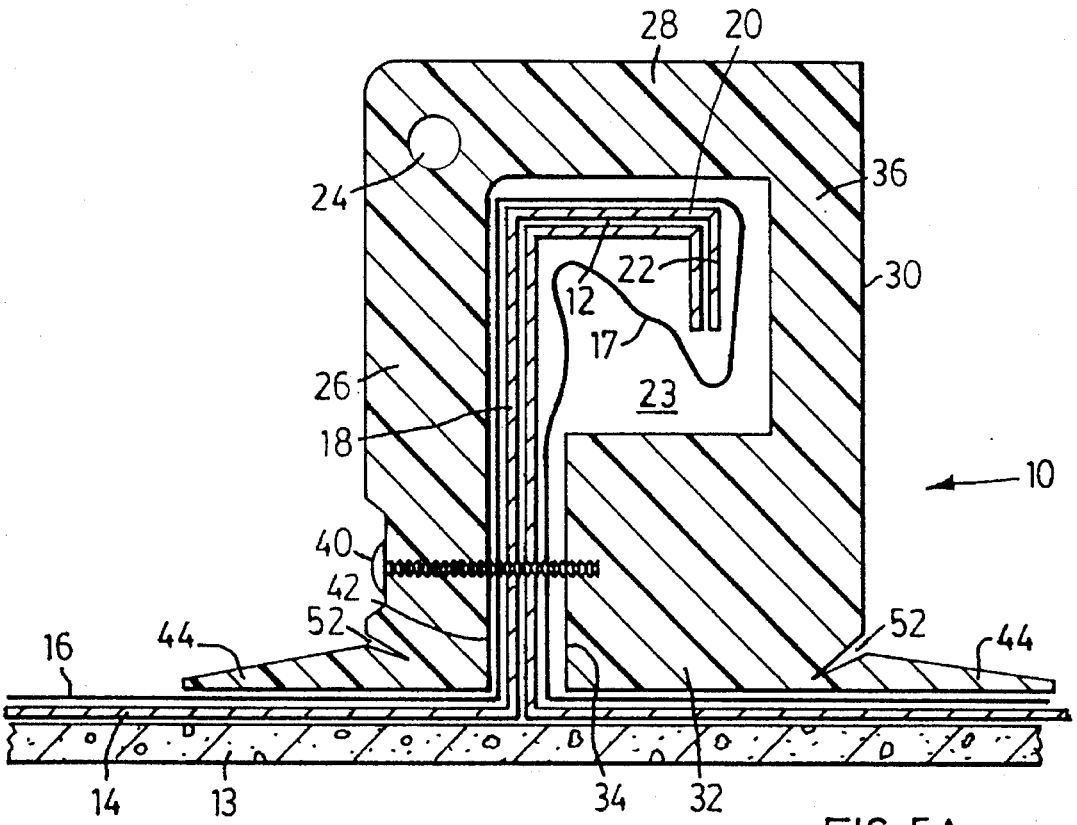
Figure 4B:
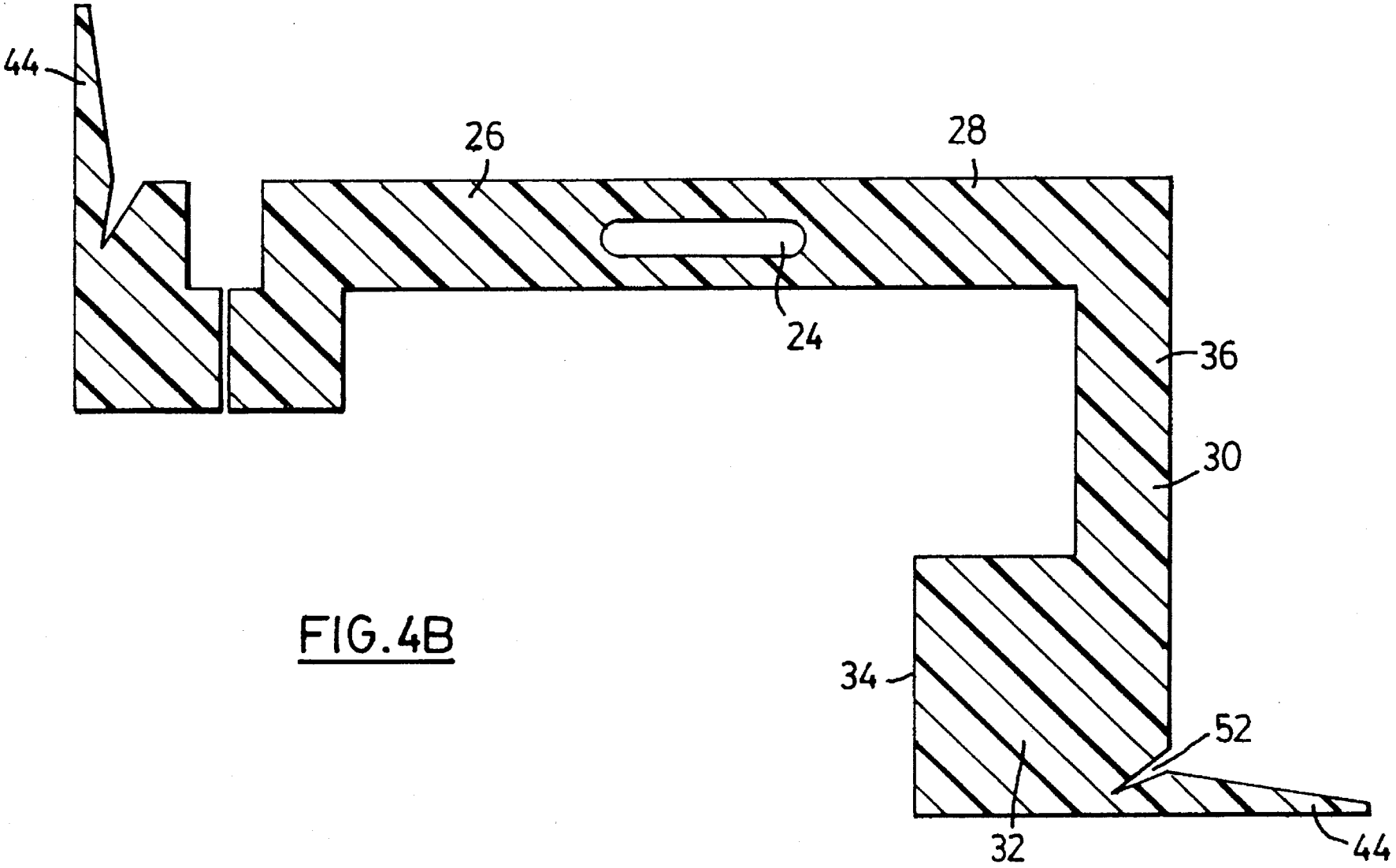
Figure 5B:
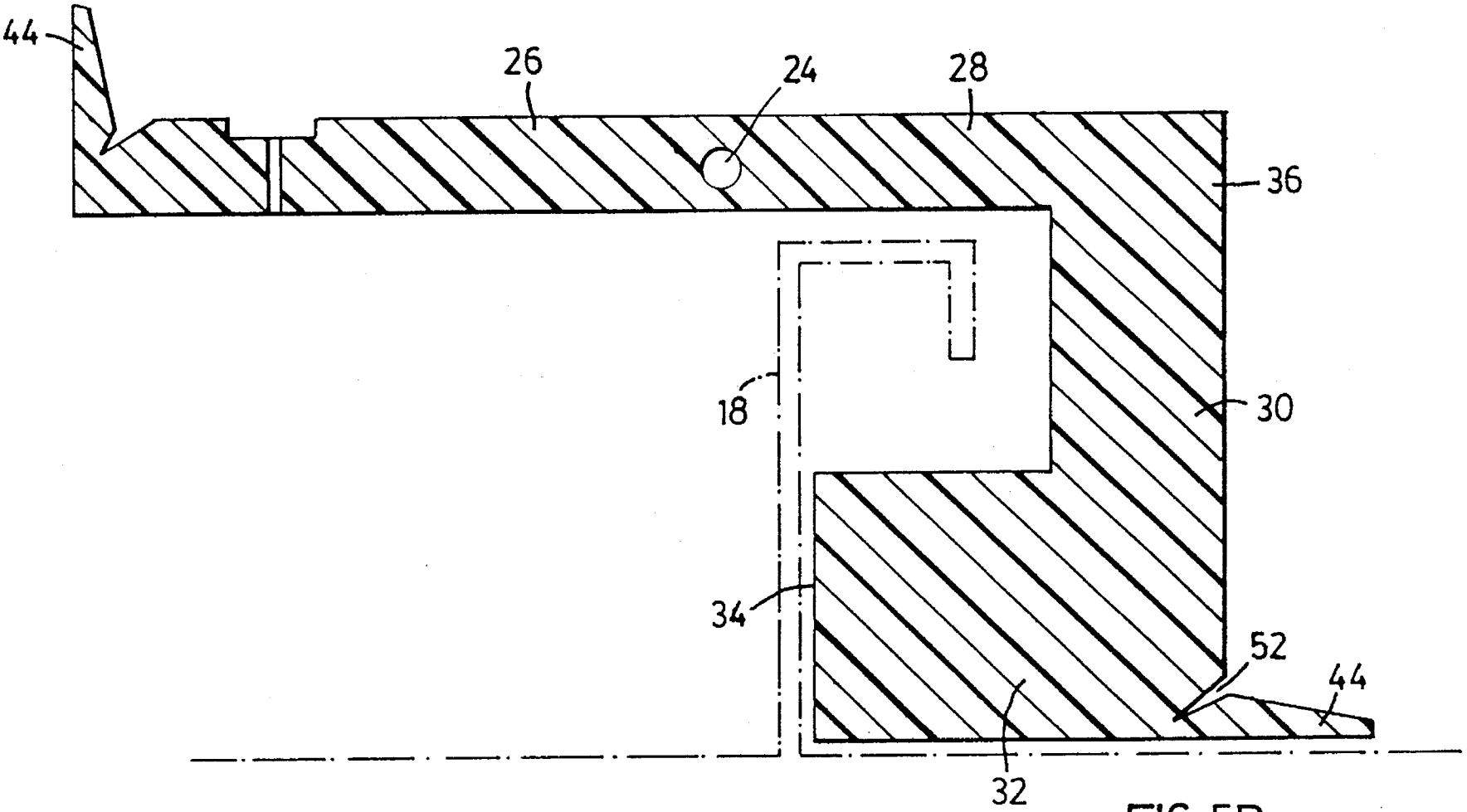

FIG. 4A and 4B respectively show other shapes of extrusion which may be useful for other shapes of standing seam. Apart from their shape they are in all other respects similar to those described with respect to FIGS. 1, 2 and 3.

Similarly 5A and 5B show bent and unbent shapes of another extrusion which may be used.

I claim:

1. A cover for a standing roof seam comprising an elongate extrusion of plastics material having:

a first side web to form a first downwardly extending side leg of the cover;

a top web and a second side web forming respectively, a top of the cover and a second downwardly extending side leg parallel to the first downwardly extending side leg;

an elongate bending region being provided between the first side web and the top web along the length of the extrusion whereby the first side web is bendable with respect to the top and second side webs into and out of position as the first downwardly extending leg;

the cover including an inner recess to accommodate laterally projecting parts of the standing seam.

2. A cover as claimed in claim 1 in which the first web has an inner surface to lie flat against one surface of the standing seam and a second web has an inner surface to lie flat against another vertical surface of the standing seam.

3. A cover as claimed in claim 1 in which the recess is formed in one of the first and second side webs.

4. A cover as claimed in claim 1 in which the recess is formed in both the first and second side webs.

5. A cover as claimed in claim 2 in which one of the first and second side webs is generally of L configuration, the recess being located in the angle of the L below the top web and the inner surface of said one of the first and second side webs which lies flat against said other vertical surface of the standing seam is comprised by an end wall of the foot of the L.

6. A cover as claimed in claim 1 in which the elongate region of bending comprises an elongate hollow tubular region within the extrusion.

7. A cover as claimed in claim 6 in which the elongate hollow tubular region is of generally rectangular cross section.

* * * * *